US005127249A

United States Patent [19]

Peyron et al.

[11] Patent Number: 5,127,249

[45] Date of Patent: Jul. 7, 1992

[54] LEVELLING INSTALLATION

[75] Inventors: Jean B. Peyron, Saint Priest en Jarez; Marc P. Furgerol, L'Horme, both of France

[73] Assignee: Clecim, Cergy Pontoise, France

[21] Appl. No.: 666,016

[22] Filed: Mar. 7, 1991

[30] Foreign Application Priority Data

Mar. 9, 1990 [FR] France ..... 90 03058

[51] Int. Cl.[5] ..... B21D 1/02

[52] U.S. Cl. ..... 72/165; 72/239; 72/160

[58] Field of Search ..... 72/164, 165, 160, 239, 72/238

[56] References Cited

U.S. PATENT DOCUMENTS

| | | | |
|---|---|---|---|
| 2,592,948 | 4/1952 | Peterson | 72/164 |
| 3,453,852 | 7/1969 | Valente | 72/164 |
| 4,745,788 | 5/1988 | Takemasa et al. | 72/160 |
| 4,974,435 | 12/1990 | Vandenbroucke | 72/226 |

FOREIGN PATENT DOCUMENTS

| | | | |
|---|---|---|---|
| 0298852 | 1/1989 | European Pat. Off. . | |
| 2134405 | 1/1973 | Fed. Rep. of Germany . | |
| 149015 | 6/1988 | Japan | 72/160 |
| 44214 | 2/1989 | Japan | 72/160 |

*Primary Examiner*—Daniel C. Crane

*Attorney, Agent, or Firm*—Pollock, Vande Sande & Priddy

[57] ABSTRACT

An installation for stretch-levelling strip metal, comprising, inside a stand, at least two bending units offset longitudinally and placed respectively above and below the strip carrying at least one work cylinder mounted rotatably about a transverse axis. The frame of at least one upper bending unit is mounted rotatably on two aligned journals about which the entire bending unit can rotate between a working position in which the work cylinder points downwards, and an inverted position in which the work cylinder points upwards and can thus easily be maintained or replaced.

13 Claims, 3 Drawing Sheets

LEVELLING INSTALLATION

FIELD OF THE INVENTION

The subject of the invention is an installation for the stretch-levelling of strip metal and, to be more precise, improvements facilitating the maintenance of such an installation. The invention relates, in particular, to levelling machines used in the various sectors of metallurgy with a view to improving the mechanical properties and the surface evenness of strip metal produced in a rolling installation.

PRIOR ART

In a general manner, a levelling machine comprises a certain number of rolls defining an undulating path and through which the strip runs and is subjected to tensile stresses permitting temper rolling To this end, the machine comprises, inside a stand, at least two longitudinally offset bending units, an upper unit and a lower unit, respectively placed above and below the strip, and separate control means for the vertical displacements of each bending unit, transversely to the plane in which the strip runs, between an adjustable levelling position and a rest position spaced apart from the strip. Such a machine generally comprises a certain number of successive bending units such as:

one or more temper-rolling assemblies proper, each consisting of an upper bending unit and a lower bending unit, which units can be adjusted vertically by mechanical or hydraulic means;

a bending unit carrying a "concavity-correction" roll which can be adjusted vertically by mechanical means;

a bending unit carrying a "convexity-correction" or "decambering" roll which can be adjusted vertically by mechanical means.

Different configurations of levelling machines can be used depending on the field of application.

Each bending unit comprises a frame extending between two ends placed on either side of the strip and carrying a work cylinder mounted rotatably about an axis transverse to the running direction. The work cylinder generally has a small diameter, in particular in the temper-rolling units, and bears on two spaced-apart rows of bearing rollers, or alternatively on two intermediate cylinders which themselves bear on three rows of rollers, the whole forming a "levelling assembly". However, if the proportions permit, for example for convexity correction, the cylinder can be supported and/or retained only at its ends.

During operation, it may become necessary to replace the work cylinders and/or the intermediate cylinders or even an entire bending unit, for purposes of cleaning or maintenance, or for installing cylinders of different diameter. To this end, it is expedient to use a disassembly device integrated with the machine and comprising a support mounted for transverse sliding movement within the stand of the machine and actuated manually or with the aid of an actuator such as a jack, and which enables the bending unit requiring maintenance to be removed, moving it away laterally to one side of the machine, it being possible for the strip metal to remain in the machine, either at standstill or during operation. In such an installation, the various control means are generally placed on the same side of the strip, the operator being positioned, with his control desk, on the other side, and it is on the side of the operator that the bending units can be moved away into disassembly position.

It is sometimes necessary to disassemble a single bending unit or a plurality of units at the same time. When it is desired to replace an entire bending unit, or alternatively a plurality of units, they are withdrawn on the side on which the operator sits using the disassembly device, and are then replaced using an external handling means such as a traveling bridge. The new bending unit or units are then reinstalled by the disassembly device inside the machine in working position.

When it is desired to replace only one, or several cylinders, the corresponding bending unit or units are withdrawn on the side of the operator using the disassembly device and the cylinder or cylinders are replaced by hand or using a handling means, the bending unit being subsequently reinstalled inside the machine by the disassembly device.

SUMMARY OF THE INVENTION

The subject of the invention are improvements to the arrangements conventionally used making it possible to facilitate maintenance, and, in particular, disassembly of the cylinder or cylinders of an upperbending unit.

According to the invention, the frame of the upper bending unit is mounted rotatably on two aligned journals rotating respectively in two support members placed respectively at the two ends of the frame and defining a horizontal axis of rotation about which the whole upper bending unit can rotate between a working position, in which the work cylinder points downwards, and a maintenance and disassembly position in which the work cylinder points upwards, resting, where appropriate, on the intermediate cylinders and on the bearing rollers.

Each bending unit is preferably mounted so as to be displaceable transversely to the running direction, between a working position in which the frame of the bending unit is placed inside the stand of the machine and is fixed detachably on corresponding means for controlling vertical displacements, and a disassembly and maintenance position in which the frame of the bending unit has been moved away laterally to one side of the stand of the machine and bears on two support members placed at its two opposite ends, the machine being associated with means for selectively controlling the transverse displacement of each bending unit between the working position and the disassembly position.

The means for controlling the transverse displacement of the bending units advantageously comprise a transfer carriage which can move transversely between a position engaging with at least one bending unit and the disassembly position. In a particularly advantageous manner, the transfer carriage comprises at least one piece for bearing on the frame of at least one bending unit, comprising a means for detachably fastening the support member of the end of the frame pointing towards the disassembly side, and the stand of the machine is equipped with rails and with rolling bearings extending transversely over its entire width and on which bears the support member of the opposite end of the frame of the bending unit via running rollers.

In a preferred embodiment, the support member of the frame of each upper bending unit placed on the disassembly side comprises a journal centered on the horizontal axis of rotation and rotating in a bearing mounted in an annular piece forming a bearing body, and the detachable fastening means of said support member comprises a jack mounted on the corresponding bearing piece of the transfer carriage and having a rod provided with a stud adapted to engage in a corresponding recess of the bearing body, it being possible for the latter to rest on a support plate associated with said stud.

Moreover, the support member of the frame of the bending unit, placed on the side opposite the disassembly side, comprises a journal centered on the horizontal axis of rotation of the assembly and rotating in a bearing mounted in a support end block bearing on two corresponding running rails via two rollers. In order to permit the displacements of the upper bending unit between its rest position and the working position, the two bearing rollers of the support end block are each mounted at one free end of an arm, the opposite end of which is mounted pivotably about a horizontal axle on the support end block, the length of which is greater than the difference in height between the rest position and the extreme working position of the bending unit, the two arms being associated with an elastic means for return to the rest position.

BRIEF DESCRIPTION OF THE DRAWINGS

The invention will be better understood from the following description of a preferred embodiment given by way of example and shown in the attached drawings.

DESCRIPTION OF THE PREFERRED EMBODIMENT

Figure 1:
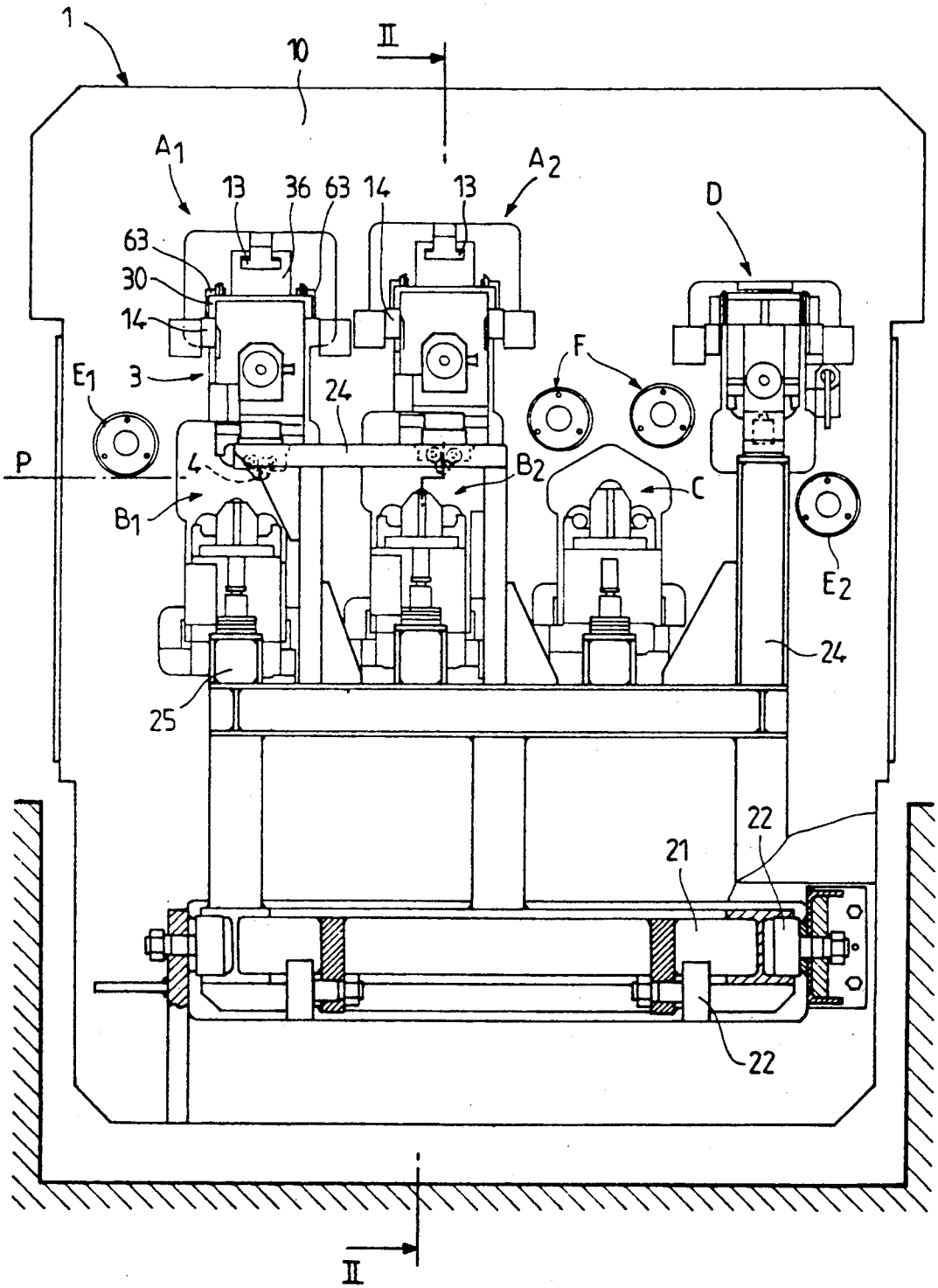
FIG. 1 shows the whole temper-rolling machine viewed from the operator side.

FIG. 1 shows, in side view, almost all of a levelling machine equipped with four bending units for levelling , two upper units A1, A2 and two lower units B1, B2, a bending unit C for concavity correction and a bending unit D for convexity correction. The strip metal M, driven by means (not shown) for controlling the running and tensioning, passes between the various bending units in a mean running plane P defined by deflection rolls $E_1$ and $E_2$ placed at the two ends of the machine. Other deflection rolls F can be associated with the various bending units between which the strip follows an undulating path, the amplitude of which depends on the respective positions of the various bending units.

The whole of the machine is placed inside a rigid stand 1 comprising two sides 10 and a base 11, and with which is associated a carriage 2 for disassembly the various bending units.

In order to clarify matters, the description which follows refers to the bending units for levelling such as A1, A2, B1 and B2, but the arrangements described could also be applied directly to the other bending units C and D.

Figure 2:
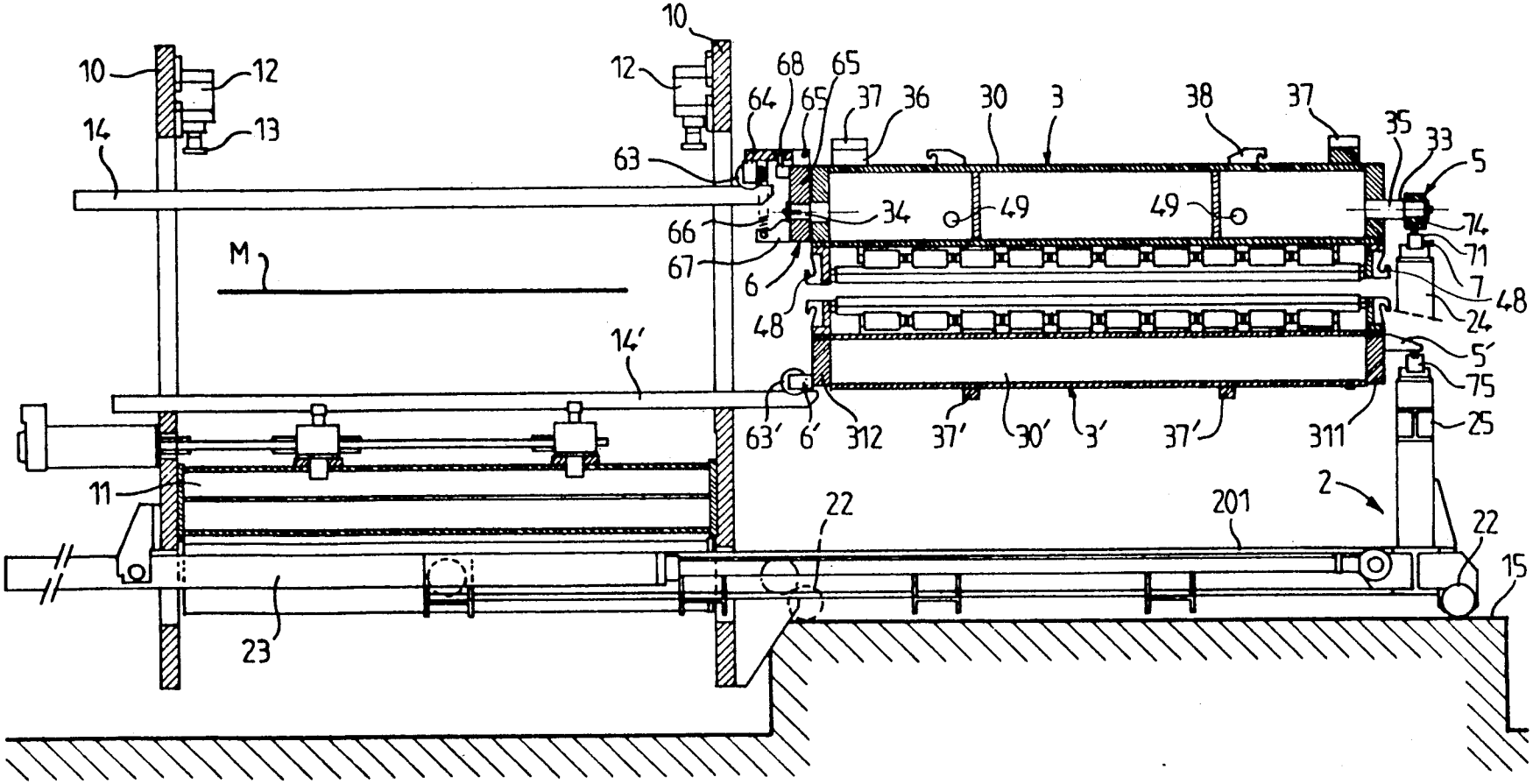
FIG. 2 is a view in cross-section along the line II—II in FIG. 1.

Two bending units, an upper unit 3 and a lower unit 3', respectively, have been shown by way of example and in the disassembly position in FIG. 2. As can be seen in more detail in FIGS. 3 and 4, each bending unit such as the upper unit 3 comprises an elongated frame consisting of a beam 30 extending between two end pieces 31, 31' and carrying a work cylinder 4 which bears on two intermediate cylinders 41. The work cylinder 4 and the intermediate cylinders 41 are mounted rotatably about parallel axes 40 between stops 32 carried by the end pieces 31. Furthermore, the two intermediate cylinders 41 bear on three rows of rollers 42 mounted rotatably on the beam 30 about axes of rotation 43 parallel to the axes 40 of the cylinders.

Each bending unit 3, 3' is mounted so as to slide vertically in the stand along parallel guide faces 39 interacting with corresponding faces 16 formed on the uprights 10 of the stand, and is associated with means 12, 12' for controlling the vertical displacements permitting each bending unit 3, 3' to move from a rest position spaced apart from the strip M into a working position, the level of which is fixed by stops.

In a known manner, the means 12 for displacing the upper unit 3 are generally double-action hydraulic jacks to which the frame 30 is attached. The means 12' for displacing the lower unit 3' on the other hand, can be simple mechanical jacks on which is placed the unit 3' and which also permit the position of the latter to be adjusted, the return to the rest position taking place under gravity.

According to an essential feature of the invention, the frame 30 of the upper bending unit is mounted rotatably on two support members 5 and 6 via two journals 33, 34 placed respectively at its two ends and centered on a horizontal axis 35 parallel to the axis 40 of the work cylinder 4.

The support member 5 placed on the side on which the disassembly takes place, in other words on the side of the operator, comprises an annular piece 51 constituting a bearing body in which the journal 33 is mounted rotatably.

The support member 6 placed on the opposite side, in other words on the control side, itself comprises an end block 61 carrying a bearing body 62 in which the journal 34 is mounted rotatably.

Furthermore, the beam 30 is equipped with suspension members 36 which can be engaged detachably on jacks 12 fixed on the sides of the stand 10 and constituting the means for controlling the vertical displacement of the bending unit 3. As can be seen, in particular, in FIGS. 2, 3 and 4, the rod of each jack 12 can be equipped with a widened head 13 which can engage slidably in a slot 37 formed on the corresponding suspension piece 36 of the frame 30.

In the working position shown in FIG. 1, the frame 30 of the upper bending unit 3 is therefore fixed by the pieces 36 to the rods 13 of the two bearing jacks 12 which enable the bending unit 3 to be placed either in a raised rest position in which the work cylinder 4 is spaced apart from the plane P in which the strip passes, or in a lowered position in which the work cylinder 4 is situated at a working level set by stops and permitting a predetermined bending to be applied to the strip M.

It can be seen that the bending unit 3 can be detached from the jacks 12 simply by being displaced horizontally parallel to the axes 40 of the cylinders.

To this end, the disassembly carriage 2 shown in FIGS. 1 and 2 is used.

As shown in FIG. 2, the carriage 2 comprises a horizontal frame 21 bearing on the floor 15 via running rollers 22 and capable of being displaced horizontally and in a direction transverse to the longitudinal running direction under the action of a jack 23, the body of which is articulated on the stand 10 of the machine and the rod of which is articulated on the frame 21 of the carriage 2. The latter can thus assume two positions, respectively an engaging position in which the frame 21 is inserted into the base 11 of the stand 10 of the machine, and a disassembly position, shown in FIG. 2, in which the frame 21 is moved away laterally on the side of the operator.

Figure 3:
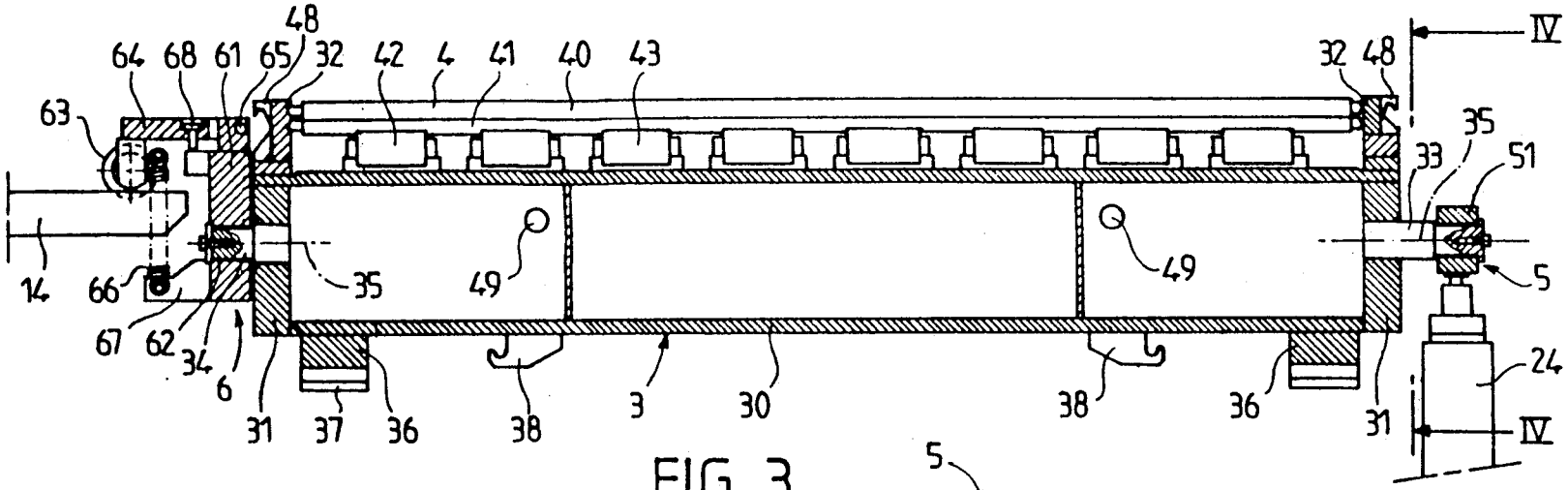
FIG. 3 is a detail view of a bending unit.
Figure 4:
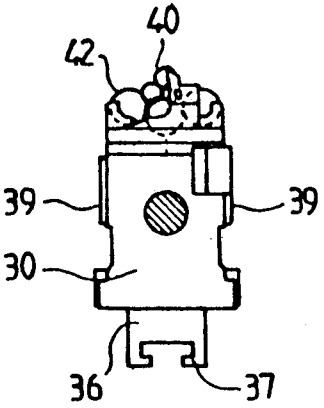
FIG. 4 is an end view in the direction of arrow IV in FIG. 3.

The transfer carriage 2 furthermore comprises bearing pieces 24, 25 in the form of a bracket which are solid with the horizontal frame 21 and extend vertically at different levels corresponding respectively to the different bending units. In particular, as can be seen in FIGS. 2 and 3, the bracket 24 for supporting the upper bending unit 3 extends as far as a level slightly below that of the axis of rotation 35 and is equipped with a fastening member which can be detached from the support member 5, placed on the side of the operator, and which can consist of a jack 7. As shown in detail in FIG. 5, the jack 7 comprises a body 71 mounted on the bracket 24, if necessary via adjustable shims, and a rod 72 which is equipped with a bearing plate 73 and with a stud 74.

When the transfer carriage 2 is placed in the engaging position, the bracket 24 is aligned with the support member 5 and, by actuating the jack 7, the plate 73 presses against the bearing body 51 which is provided with a receptacle 52 into which the stud 74 engages.

The support member 6 placed at the opposite end of the frame 30 of the bending unit 3 itself bears, via running rollers 63, on horizontal rails 14 extending transversely between the two sides 10 of the stand. In order to permit the vertical displacements of the frame 30, each running roller 63 is mounted at the free end of an arm 64, the other end of which is articulated, about a horizontal axle 65, on the end block 61 of the support member 6. Springs 66 tensioned between each arm 64 and a fastening piece 67 solid with the end block 61 enable the frame 30 to be retained in the raised position shown in FIG. 2 in which the suspension pieces 36 are situated at the level of the heads 13 of the control jacks 12. Screws 68 make it possible to set the upper position into which the frame 30 is returned under the action of the springs 66 in such a way that, in this position, the slots 37 are situated exactly at the desired level.

It can thus be seen that, when the transfer carriage 2 is inserted into the stand 10 in the engaging position, and when the jack 7 is actuated, the bending unit 3 is carried, on the side of the operator , by the bracket 24 and the jack 7 and on the opposite side by the rollers 63. If the transfer carriage 2 is then moved away laterally by means of the jack 23, the support member 5, linked to the bracket 24 by the stud 74, drives in displacement the bending unit 3, the other end of which runs on the rails 14 via the rollers 63.

Conversely, if the carriage 2 carrying the bending unit 3 is returned inside the stand 10, the suspension pieces 36 engage on the heads 13 of the jacks 12 which engage with the bending unit 3. The transfer frame 2 is then moved away and the bending unit 3 can be lowered. The arms 64, which can rotate about their axles 65 with simple tensioning of the springs 66, do not oppose the vertical displacement of the unit 3.

When the upper unit 3 is situated in the disassembly position shown in FIG. 2, it is possible to rotate it, for example manually, about the horizontal axis 35 defined by the journals 33 and 34, it being possible for the assembly to be balanced so as to facilitate the reversing. The unit 3 is preferably locked in the reversed position by appropriate means which will be described later.

In this inverted position, the work cylinder 4 points upwards resting on the intermediate cylinders 41, and it is therefore possible to act on the cylinders easily, for example in order to clean, repair or replace them.

Such an intervention can take place either on site or in the workshop. Indeed, the unit 3 can be transported in its inverted position by means of hooks 48 placed at the level of the cylinders, or alternatively by means of bars passing through holes 49 made in the frame 30. There is consequently no need to reverse the unit 3 in the workshop, this operation taking place more easily on site using the arrangements according to the invention.

It is, of course, also possible to transport the upper unit 3 in its normal position by means of hooks 38 fixed on the frame 30 on the side opposite the cylinders.

Figure 5:
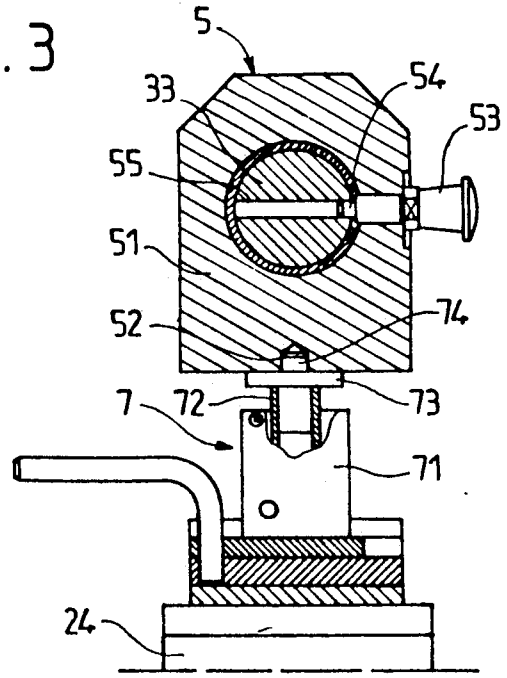
FIG. 5 is a detail view of the support member of the disassembly side in a section transverse to the axis of rotation.

A means for locking the frame 30 in the inverted position is shown in detail, by way of example, in FIG. 5.

As can be seen, the support member 5 is equipped with a fastening device 53 comprising a finger 54 which can engage in a bore 55 passing diametrally through the journal 33. The support member 6, placed on the opposite side, is equipped with a similar fastening device. The frame 30 is thus fixed in the inverted position shown in FIG. 3. In this position, each work cylinder 4 points upwards and rests simply on the intermediate cylinders 41, the latter resting themselves on the three rows of rollers 42.

The same arrangements can be applied to the decambering unit D. In this case, the cylinder of the decambering unit can have a larger diameter and, if necessary, can resist the bending alone by bearing on its bearings 32, the bearing rollers 42 then being dispensed with.

The invention therefore makes it possible to intervene very easily on the bending unit 3 in order to attend to or replace one the cylinders 4 and 41 or bearing rollers 42, as appropriate Then, the two studs 54 need only be withdrawn and the frame 30 rotated in order to return it into the working position in which the work cylinders point downwards.

It will be noted that, if the whole bending unit 3 is well balanced about the axis 35, the studs 54 need not be subjected to a substantial stress in order to retain the bending unit in either of its two positions. When in service, the support members 5 and 6, and consequently the studs 54, need not be subjected to any stress, the frame 30 being guided by plane faces 39 sliding along corresponding faces 16 formed on the uprights 10 of the stand of the machine.

The arrangements which have just been described can be applied to any upper bending units, in other words, in the case of FIG. 1, the units A1 and A2 and the convexity-correction or decambering unit D. On the other hand, the lower units such as B1 and B2 and the concavity-correction unit C need not be pivotably mounted since the work cylinders point upwards. In addition, the return of the lower bending unit into the rest position can take place under the action of its own weight. This is why, as can be seen in FIG. 2, each lower bending unit 3' will be mounted in a more simple manner, the support members being dispensed with.

As a result, the end plate 311 facing the side of the operator is equipped with a simple cantilever part 35 which can rest on a jack 75 mounted on the bracket 25 and having a rod equipped, as above, wit a stud engaging in a corresponding recess of the cantilever part 350 so that the frame 30' is driven by the transfer carriage 2 for the disassembly.

At the other end of the frame 30', the opposite plate 312 bears directly on rails 14' via rollers 63'.

In its lower part, the frame 30' can be equipped with hooking members 37' which engage on the rods of jacks 12' for controlling the displacement these, in the example shown, are mechanical jacks.

The arrangements provided for the disassembly or the reversing of the bending units can be modified to adapt to other embodiments of the bending units or to other types of levelling machines.

In particular, the arrangements described with reference to an upper levelling unit such as A1 or A2 also apply to any other bending unit such as, for example, in FIG. 1, the decambering unit D.

Furthermore, a conventional installation has been described in which the anti-concavity assembly C is beneath the product and the decambering assembly D above it. For ease of construction or as a result of process requirements, this arrangement could, however, be inverted, the anti-concavity assembly being placed in the upper part. The arrangements described for the upper levelling units could then advantageously be applied to an anti-concavity bending unit placed in this manner.

What is claimed is:

1. An installation for stretch-levelling strip metal, comprising a temper rolling machine traversed by a strip in a longitudinal direction, said strip being subjected to tensile stresses, said temper rolling machine comprising, inside a stand, (a) at least two bending units offset longitudinally, an upper unit and a lower unit respectively located above and below said strip, said offset of said bending units causing said strip metal to be fed along an undulating path through said machine;

(b) each said bending unit comprising a work cylinder associated with at least two intermediate cylinders, said work cylinder and intermediate cylinders being rotatably mounted about parallel transverse axles in a frame extending between two ends placed on either side of said strip, said work cylinder being arranged to contact said strip metal;

(c) the frame of at least one upper bending unit being mounted rotatably on two aligned journals respectively rotating in two support members, placed respectively at the two ends of said frame and defining a horizontal axis of rotation about which the whole of the upper bending unit can rotate between a working position in which said work cylinder points downwards and is operatively oriented to contact said strip metal, and an inverted maintenance and disassembly position in which said work cylinder points upwards out of contact with said strip metal;

(d) said at least one upper bending unit comprising said work cylinder, said at least two support members being mounted so as to be displaceable transversely to a direction of travel of said strip between a working position, in which said frame of said bending unit is placed inside said stand of said temper rolling machine, and a disassembly and maintenance position in which said frame is spaced apart laterally to one side of said stand and bears on said two support members placed at its two opposite ends, said temper rolling machine being associated with means for selectively controlling transverse displacement of said bending unit between said working position and said disassembly position.

2. The levelling installation as claimed in claim 1, wherein at least said frame of said at least one upper bending unit is mounted in working position so as to slide vertically in said stand, and is detachably fixed on corresponding means for controlling vertical displacements of said at least one upper bending unit transversely to a plane of travel of said strip, between said working position and a rest position spaced apart from said strip.

3. The levelling installation as claimed in claim 1 or 2, wherein said means for controlling transverse displacement of said at least one upper bending unit comprise a transfer carriage movable transversely between a position engaging with said upper bending unit in the working position and the disassembly position, and on which transfer carriage is mounted at least one bearing piece for bearing on the frame of at least one bending unit, said bearing piece comprising a means for detachably fastening said support member of the end of said frame pointing towards a disassembly side of said installation, said stand being provided with at least one running rail extending transversely over its entire width and on which bears said support member of the opposite end of said frame and of said bending unit via running rollers.

4. The levelling installation as claimed in claim 1 or 2, wherein the frame of the lower bending unit is mounted in working position so as to slide vertically in said stand and is fixed detachably on corresponding means for controlling vertical displacements of said lower bending unit transversely to the plane of travel of said strip, between said working position and a rest position spaced apart from said strip.

5. The levelling installation as claimed in claim 4, wherein the frame of the lower bending unit is mounted so as to be displaceable transversely to the direction of travel of said strip between a working position, in which the frame of said lower bending unit is placed inside said stand, and a disassembly and maintenance position in which the frame is spaced apart laterally to one side of said stand and bears on said two support members respectively placed at its two opposite ends, said levelling machine being associated with a transfer carriage adapted to move transversely between a position engaging with said lower bending unit in the working position and the disassembly position, and on which is mounted at least one piece for bearing on the frame of said lower bending unit, said piece comprising a means for detachably fastening the support member of the end of said frame pointing towards said disassembly side of said installation, said stand being provided with at least one running rail extending transversely over its entire width and on which bears the support member of the opposite end of the frame and of the lower bending unit via running rollers.

6. The levelling installation as claimed in claim 3, wherein the running rollers (63) placed at the end (31) of the frame (30) of the upper bending unit (3) opposite the disassembly side are connected to the support member (6) by a linking piece (64) adapted to move between a raised position and a lowered position at an adjustable level, for which positions the upper bending unit (3) is situated respectively in the rest position and in the working position.

7. The levelling machine as claimed in claim 3, wherein the support member on the disassembly side of the frame of each bending unit comprises an annular piece forming a bearing body in which is rotatably mounted a journal integral with the end of the frame and centered on the horizontal axis of rotation, and wherein the detachable fastening means of said support member comprises a jack mounted on the corresponding bearing piece of the transfer carriage and having a rod provided with a stud adapted to engage in a corresponding receptacle of the bearing body, said bearing body being adapted to rest on a support plate associated with said stud.

8. The levelling installation as claimed in claim 3, wherein the support member (6) of the frame (30) of the upper bending unit (3) placed on the side opposite the disassembly side comprises an end block (61) carrying a bearing body (67) in which is rotatably mounted a journal (34)integral with the end (31) of the frame (30) and centered on the horizontal axis of rotation (35), said end block (61) bearing on the two corresponding running rails (14) via two rollers (63).

9. The levelling installation as claimed in claim 8, wherein the two bearing rollers (63) of the support end block (61) are each mounted at one free end of an arm (64), the opposite end of which is mounted pivotably about a horizontal axle (65) on the support end block (61) and the length of which is greater than the difference in height between the rest position and the extreme working position of the bending unit (3), the two arms (64) being associated with an elastic means (66) for returning the frame (30) into its rest position.

10. The levelling installation as claimed in claim 3, wherein at least one of the two support members (5, 6) is equipped with a member (54) for locking the frame (30) of the bending unit (3) at least in the inverted position.

11. The levelling installation as claimed in claim 10, wherein the member for locking the frame (30) comprises a stud (54) mounted for sliding movement on the support member (5, 6) transversely to the journal (33), (34) and engaging detachably in a bore (55) formed in said journal (33), (34).

12. The levelling installation as claimed in claim 11, wherein the bore (55) in which the locking stud (54) engages passes diametrally through the journal (33), (34) so as to create two locking positions of the frame (30), in the working position and in the inverted maintenance position respectively.

13. The levelling installation as claimed in claim 3, wherein the frame (30) of the upper bending unit (3) is provided with hooking means (48, 49) for transporting the unit (3) in the inverted position

* * * * *